US006212732B1

(12) United States Patent
Tajima et al.

(10) Patent No.: US 6,212,732 B1
(45) Date of Patent: Apr. 10, 2001

(54) VACUUM CLEANER AND SUCTION NOZZLE BODY THEREFOR

(75) Inventors: Taiji Tajima, Tsukuba; Shigesaburou Komatsu, Chiyoda-machi; Shigenori Satou, Yasato-machi; Toshiya Shinozaki, Sanwa-machi; Yukiji Iwase, Ushiku; Masao Sunagawa, Mito; Wataru Yamamoto, Hitachi; Susumu Satou, Takahagi, all of (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 08/913,356

(22) PCT Filed: Mar. 15, 1995

(86) PCT No.: PCT/JP95/00427

§ 371 Date: Jun. 19, 1998

§ 102(e) Date: Jun. 19, 1998

(87) PCT Pub. No.: WO96/28081

PCT Pub. Date: Sep. 19, 1996

(51) Int. Cl.[7] ..... A47L 5/30
(52) U.S. Cl. ..... 15/339; 15/387
(58) Field of Search ..... 15/387, 339

(56) References Cited

U.S. PATENT DOCUMENTS

| | | | | |
|---|---|---|---|---|
| 500,415 | * | 6/1893 | Neal | 15/387 |
| 1,209,721 | * | 12/1916 | Kirby | 15/387 |
| 1,209,722 | * | 12/1916 | Kirby | 15/387 |
| 1,323,925 | * | 12/1919 | Stewart | 15/387 X |
| 2,063,253 | * | 12/1936 | Kuhnel | 15/387 X |
| 2,777,152 | | 1/1957 | Consentino . | |
| 2,993,224 | * | 7/1961 | Child | 15/339 |
| 3,855,665 | * | 12/1974 | Schwartz | 15/339 |
| 5,802,666 | * | 9/1998 | Jung | 15/387 |

FOREIGN PATENT DOCUMENTS

| | | | |
|---|---|---|---|
| 40 35 411 A1 | | 5/1992 | (DE) . |
| 338414 | * | 11/1930 | (GB) ..... 15/387 |
| 52-122574 | | 9/1977 | (JP) . |
| 57-69665 | | 4/1982 | (JP) . |
| 5-176870 | | 7/1993 | (JP) . |
| 7-008425 | | 1/1995 | (JP) . |
| 59310 | | 6/1984 | (TW) . |
| 137875 | | 7/1990 | (TW) . |
| 242560 | | 3/1995 | (TW) . |
| PCT/US85/01648 | | 8/1986 | (WO) . |

* cited by examiner

*Primary Examiner*—Chris K. Moore
(74) *Attorney, Agent, or Firm*—Antonelli, Terry, Stout & Kraus, LLP

(57) ABSTRACT

At an interior portion of a suction nozzle body, an impeller and a brush member are installed. The impeller is rotated in response to an air flow produced by a suction force and a brush or a blade member is mounted in a spiral shape along the whole impeller or a part of the impeller and contacts a surface to be subjected to cleaning. The rotary brush rotates integrally with the impeller on the same shaft and no partition wall is provided between the impeller and the rotary brush. A suction nozzle body having a small size, and which is of light weight and provides for silent operation, and a vacuum cleaner using the same, can be provided.

21 Claims, 6 Drawing Sheets

VACUUM CLEANER AND SUCTION NOZZLE BODY THEREFOR

BACKGROUND OF THE INVENTION

The present invention relates to a vacuum cleaner and to a suction nozzle body thereof; and, more particularly, the invention relates to a vacuum cleaner comprising a suction nozzle having a rotary brush (in particular a rod shaped member constituted by a rotary impeller member having a brush member wound thereon in a spiral shape) and in which a suction force can serve as a driving power source to rotate the brush member, and to a suction nozzle body thereof.

In conventional vacuum cleaners, in particular those with a suction nozzle having a rotary brush in which the suction force serves as a driving power source to drive the rotary brush, the rotation of an impeller is transmitted to the rotary brush through a pulley member or a belt member. With such a structure, since the impeller and the rotary brush are mounted as separate elements, the whole suction nozzle body becomes large and is heavy.

Thus, as described in Japanese patent laid-open publication No. Sho 63-214,217 and Japanese patent laid-open publication No. Sho 64-58223, it has been proposed to provide a suction nozzle having a rotary brush which is rotated integrally with an impeller and is mounted on the same shaft therewith, and a suction nozzle body forming a turbine chamber which encloses the impeller using a partition wall. Further disclosures of the above stated kind of apparatus are provided in Japanese utility model laid-open publication No. Sho 54-177,170 and Japanese utility model laid-open publication No. Sho 57-69,665.

Among the above-stated conventional techniques, in an apparatus wherein the rotary brush of the suction nozzle body is driven by an impeller mounted on another shaft, the volume of the impeller is large, and, as a result, there is a problem in that the size of the suction nozzle body becomes large. Further, since the impeller rotates with a rotation speed about from three times to four times that of the rotary brush, there is a problem in that substantial noise is generated.

Further, in an apparatus wherein the impeller and the rotary brush are mounted on the same shaft, the air sucked from outside of the suction nozzle body passes through a surface to be subjected to cleaning. The air transports dust swept up using the brush member or the blade member of the rotary brush, after which the air passes through the suction nozzle body. The air enters into the turbine chamber which is enclosed using a partition wall and collides with the impeller and generates a torque.

When the suction nozzle body is lifted up, since the resistance against rotation of the rotary brush becomes small, the rotary brush rotates with an abnormally high speed of rotation, and so increased noise is generated. Further, since the suction inlet is exposed, if an operator accidentally inserts his or her fingers into the suction nozzle body, there is a problem that they may be injured.

Further, since the dust on the floor passes through the nozzle, it is impossible to make the cross-sectional area at the nozzle outlet small, thereby it is impossible to increase the velocity of the air flow which impacts and drives the impeller. As a result, there is a problem in that it is difficult to generate a sufficient torque for rotation of the rotary brush.

SUMMARY OF THE INVENTION

An object of the present invention is to provide a suction nozzle body having a small size, a light weight and which is silent in operation for use in a vacuum cleaner, and a vacuum cleaner using the same.

The above stated object is attained by providing, in an interior portion of a suction nozzle body, an impeller (which also may be referred to as a runner) which is rotated in response to the suction force producing an air flow which impacts on the impeller or a part of the impeller, an attachment of a brush member or a blade member (which also may be referred to as a soft material blade member, for example, a blade member having a flexibility, like a rubber spatula, compared with the material of the conventional impeller) which contacts a surface to be subjected to cleaning.

Or, the above stated object is attained by provision of a rotary brush rotated integrally on the same shaft with an impeller, but with no provision of a partition wall or other obstruction between the impeller and the rotary brush, and further the object is attained in that all of the fluid or a part of the fluid which is sucked from outside of the suction nozzle body collides with the impeller and forces the impeller to rotate, after which the fluid passes along the surface to be subjected to cleaning and is finally sucked into the main body of the vacuum cleaner.

Namely, the vacuum cleaner according to the present invention comprises an electric blower motor for generating a suction force, a casing for receiving the electric blower motor, a dust collection part formed in the casing at a suction side of the electric blower motor, a hose and/or an extension pipe connected at one end to an opening portion of the casing, which opening portion communicates with the duct collection part, a switch operation unit positioned at a midway point of the hose and/or the extension pipe or positioned in the vicinity of a connection portion of the hose and the extension pipe for controlling the driving operation of the electric blower motor, and a suction nozzle body connected to the other end of the hose and/or the extension pipe, in which the suction force of the electric blower motor is utilized for cleaning a surface to be subjected cleaning. For this purpose, the desirable features of the invention include the following:

(1) An impeller is provided in an interior portion of the suction nozzle body and rotates in response to an air flow produced by the suction force, a brush member and/or a blade member is attached to the whole impeller or to a part of the impeller and contacts the surface to be subjected to cleaning, the whole impeller or the part of the impeller serving as a rotation brush member and/or a rotation blade member.

(2) In the arrangement of the above item (1), the brush member and/or the blade member is attached in a spiral shape to the impeller using a single brush member or plural brush members, a single blade member or plural blade members, or plural brush members and blade members in a combined shape.

(3) In the arrangement of the above stated items (1) or (2), the length of the impeller is longer that a half length in the longitudinal direction of the interior portion of the suction nozzle body.

(4) In any one of the arrangements of the above stated items (1) to (3), the brush member and/or the blade member extends over a vane of the impeller toward at an outer periphery side thereof.

(5) In any one of the arrangements of the above stated items (1) to (4), a housing is provided to enclose the impeller, and an opening is provided in the housing which opens toward a floor surface.

(6) In any one of the arrangements of the above stated items (1) to (5), separately provided in inlet nozzles are disposed in the vicinity of both ends of the suction nozzle body for sucking air into the suction nozzle body from outside, an outlet nozzle is formed at a portion where a tip end of the hose and/or the extension pipe is connected to a center portion of the suction nozzle body, and with respect to an axial extension line of the outlet nozzle, the inlet nozzles in the vicinity of the respective ends are arranged symmetrically.

(7) In the arrangement of the above stated item (6), the diameter of the impeller is large at both ends of the suction nozzle body, but is small at the center portion thereof.

(8) In any one of the arrangements of the above stated items (1) to (5), an air inlet is provided at a central portion of the suction nozzle body for sucking air into the suction nozzle body from outside, air flow passages are formed at respective ends of an air receiving region of the impeller in an interior portion of the suction nozzle body, and an outlet nozzle is formed at a portion where a tip end of the hose and/or the extension pipe is connected at a center portion of the suction nozzle body.

(9) In any one of the arrangements of the above stated items (1) to (8), the diameter of the impeller is set to have a rotation torque on a carpet of more than 50 gr.cm, but less than 200 gr.cm, desirably the rotation torque is more than 80 gr.cm but less than 100 gr.cm.

(10) An impeller is provided in an interior portion of the suction nozzle body and is forced to rotate according to the suction force, a rotary brush is provided to rotate integrally on the same shaft with the impeller, and between the impeller and the rotary brush, a partition wall etc. is not provided (namely, in an axial direction, the air flow passage is formed without an obstacle to air flow, such as the partition wall).

(11) In the arrangements of the above stated item (10), a lower face of the rotary brush is allowed to bear against a floor surface through an opening in the suction nozzle body, but a part of the suction nozzle body where the impeller exists is not opened.

(12) In the arrangements of the above stated items (10) or (11), the diameter of a shaft of the rotary brush including a brush member or a blade member is larger than the diameter of the impeller.

(13) In any one of the arrangements of the above stated items (10) to (12), the diameter of a shaft of the rotary brush not including a brush member or a blade member is smaller than the diameter of the impeller.

(14) In any one of the arrangements of the above stated items (10) to (13), a blade member is attached to a shaft of the rotary brush.

(15) An air flow regular passage is formed by impacting all of the fluid or a part of the fluid sucked through an outside portion of the suction nozzle body using the impeller, and, after that the fluid passes along the surface to be subjected to cleaning and is sucked into the main body of the vacuum cleaner.

(16) In the arrangement of the above stated item (15), a single nozzle or plural nozzles for blowing air in the rotation direction of the impeller are provided.

(17) In the arrangements of the above stated items (15) or (16), an air inlet and an air outlet provided in an interior portion of the suction nozzle body are not positioned on a straight line.

(18) In any one of the arrangements of the above stated items (10) to (17), the switch operation unit comprises a switch group for controlling ON-OFF operation of a power source and the suction force, and means for transmitting an operation signal from the switch operation unit to a main body of the vacuum cleaner through a radio wave signal.

(19) In any one of the arrangements of the above stated items (1) to (18), the speed of rotation of the impeller is more than 1,000 r/min, but less than 10,000 r/min.

(20) In any one of the arrangements of the above stated items (1) to (19), the area of an inlet nozzle for sucking air from outside of the suction nozzle body is set to have a static pressure at an interior portion of the suction nozzle body of more than −3,000 Pa, but less than −200 Pa on a carpet.

(21) In any one of the arrangements of the above stated items (1) to (20), a vane of the impeller itself has a twist construction.

(22) In any one of the arrangements of the above stated items (1) to (21), wheels are attached to a bottom portion and a side portion of a casing of the suction nozzle body so that a difference is established in the amount by which the suction nozzle body will sink-into the surface to be subjected to cleaning, thereby varying the speed of rotation of the impeller, in response to the hardness of the floor, such as provided by a carpet as opposed to a solid floor.

(23) In any one of the arrangements of the above stated items (1) to (22), the speed of rotation of the brush member on a carpet is more than 1,000 r/min, but less than 10,000 r/min, desirably the rotation speed is more than 3,000 r/min, but less than 4,000 r/min, and the speed of rotation on a floor is less than the rotation speed on a carpet.

(24) In the arrangement of the above stated item (23), the speed of rotation of the brush member on a carpet is larger than the speed of rotation thereof when the suction nozzle body is lifted off the floor, or the rotation speed on the carpet is larger than the rotation speed on the floor, and the rotation speed on the floor is larger than the rotation speed which occurs when the suction nozzle body is lifted up, and the rotation torque of the impeller on the carpet is larger than the rotation torque of the impeller the suction nozzle body is lifted off the floor.

(25) In any one of the arrangements of the above stated items (1) to (24), in a case where the suction nozzle body is lifted up, a mechanism for automatically slowing or stopping the rotation of the impeller is provided.

(26) In any one of the arrangements of the above stated items (1) to (25), means for selectively controlling the size of an opening portion in the suction nozzle body in contact with the floor surface is provided.

In the suction nozzle body according to the present invention, a suction force produced by an electric blower motor is used for cleaning a surface to be subjected to cleaning, and an impeller which can rotate in response to an air flow produced by the suction force is mounted at the interior portion thereof. To the whole impeller or a part of the impeller, a brush member and/or a blade member is attached to contact the surface to be subjected to cleaning, and the whole impeller or a part of the impeller serves as a rotation brush member and/or a rotation blade member.

In the present specification, which includes the present invention, the term "carpet" refers to a standard type carpet.

Namely, the standard type carpet is that described in document A, page 51, which is an attachment of the International Electric Standard Conference (IEC) publication 312, a second print (1981) published by Japanese Electric Industry Association, as a corporate juridical person, Vacuum Cleaner Technical Committee, on August 31, Showa 58 (1983).

In accordance with IEC-SC59F (Secretariat) 26, UA method of measuring performances of a vacuum cleaner", appendix A, Sub-clause A, 1.1.2, in the embodiments according to the present invention, a carpet is adopted having the following conditions and weight. In other words, a wilton carpet is an all wool wilton type and has a pile height of 6–7 mm, a pile weight of 1.40–1.55 kg/m$^2$, V tuft type pile and a tuft number of 140,000–175,000 per m$^2$. This carpet for testing is also regulated in Japanese Industrial Standard (JTS) as JIS-L-4404 (a fiber carpet). Further, the term "floor" refers to a wooden floor, but also includes "tatami". As to the floor, it is a standard floor as indicated in the above stated appendix A.

Further, in the present specification according to the present invention, the "impeller" directly generates torque (the rotation force) when impacted by an air flow having a directional property and it is preferable to form the impeller integrally using a metal material (aluminum) or a plastic resin mold material. Namely, a vane portion has a larger rigidity than that of the brush member (a general term referring to a brush member and a blade member). Further, the brush member includes sponge-like matter as a general concept, and the blade portion is constituted by a blade member alone and a combination of the blade member and the brush member. The rigidity of the blade member is lower than that of the blade portion.

Next, the functions according to the present invention will be explained. Since a whole fluid or a part of the fluid sucked from an outside portion of the suction nozzle body impacts first with an impeller, it is possible to generate a sufficient torque to force the impeller to rotate.

Further, since there is no partition wall between the impeller and the rotary brush, in a case where the suction nozzle body is lifted up, substantially all of the air is sucked the opening portion facing the floor surface and the suction through the air inlet nozzle hardly exists, with a result that the impeller hardly rotates. Accordingly, an operator who accidentally inserts his or her fingers into the suction nozzle body will not be subjected to injury.

It is preferable to set the length of the impeller so that it is longer than a half of the longitudinal length of the interior portion of the suction nozzle body. In the conventional technique, the impeller and the brush member are constituted on the same shaft, however the blade portion and the impeller portion are completely separated, so that at the blade portion it is impossible to sweep up the dust.

Therefore, it is necessary to shorten the blade portion in order to enlarge the range of floor surface to be cleaned. However, in accordance with the present invention, since the impeller and the brush member are constituted integrally, the length of the impeller can be relatively long.

It is preferable to set the speed of rotation of the impeller to be more than 1,000 r/min, but less than 10,000 r/min. The reason is that, where the impeller does rotate at a speed of more than 1,000 r/min, it is impossible to sweep up dust effectively.

In general, in a case where the speed of rotation of the impeller is large, then the dust collection ability becomes high; however, when the rotation speed of the impeller exceeds 10,000 r/min, the dust collection ability saturates, but the noises accompanying the rotation of the impeller become large.

Further, it is preferable to set the cross-sectional area of the inlet nozzle for sucking air from outside of the suction nozzle body to provide a static pressure at the interior portion of the carpet of more than −3,000 Pa, but less than −200 Pa, on a carpet. The cross-sectional area of the inlet nozzle is determined in accordance with the static pressure in the suction nozzle body, but in a case where the absolute value of the static pressure is low (the negative pressure is small) and does not reach −200 Pa, the velocity of the air flow for impacting the impeller through the nozzle becomes slow, and accordingly it can not generate a predetermined torque.

However, in a case where the absolute value of the static pressure is high (the negative pressure is large) and exceeds −3,000 Pa, the suction nozzle body sticks to the carpet making it extremely different to move the suction nozzle body on the carpet, and further, the air leakage from the floor surface becomes large, with the result that the torque saturates.

It is desirable to set small as much as possible the diameter of the impeller to be as small as possible in the condition where a required rotation torque is obtained. Accordingly, it is preferable to have the torque on the carpet exceed 50 gr.cm (desirably more than 80 gr.cm), but be less than 200 gr.cm (desirably less than 100 gr.cm). It is effective to determine the diameter of the impeller within the above stated range.

With respect to the carpet, the optimum rotation speed for the surface to be subjected to cleaning is more than 1,000 r/min (desirably more than 3,000 r/min), but less than 10,000 r/min (desirably less than 4,000 r/min). With respect to a wooden floor and a tatami, since the brush member basically does, not contact the floor and the tatami, there is no optimum rotation number, but from an aspect of the noise which is generated, it is preferable to use a low speed (less than 50 dB).

The desirable rotation speed of the brush member is a relationship in which the rotation speed on the carpet>the rotation speed when the nozzles is lifted off the floor; however, in the prior art, the relationship is that the rotation speed on the carpet<the speed when the nozzle is lifted up. The desirable toque is a relationship in which the torque on the carpet>the torque when the nozzles is lifted up; however, in the prior art the torque does not change whether the nozzle is on the carpet or lifted off the carpet.

Further, according to the present invention, all of the fluid or a part of the fluid which is sucked from the outside of the suction nozzle body impacts at first with the impeller and the impeller is rotated. After that, the air is formed into a flow, which is sucked into the main body of the vacuum cleaner after passing along the surface to be subjected to cleaning.

However, in the prior art, the air flow which is sucked from outside of the suction nozzle body passes first along the surface to be subjected to cleaning so that the air includes dust which is swept up and then impacts the impeller in the nozzle body. The impeller is forced to rotate by the dirty air, which has also lost some of its velocity, and after that the air is sucked into the main body of the vacuum cleaner.

According to the present invention, since the brush member is mounted with the impeller on the same shaft, a vacuum cleaner suction nozzle body which is of small size, is light in weight and provides silent operation can be provided.

Further, when the suction nozzle body is lifted off the floor, since the speed of rotation of the impeller is automatically reduced or stops, noises due to high rotation of the rotary brush are not generated, and further the safety of the operator can be assured even if the operator accidentally inserts his or her fingers into the suction nozzle body.

Further, at the portion where the brush member contacts the floor surface, since the high speed air flow also contacts the floor surface, the removal of the dust from the floor can be performed easily, and the removed dust can be transported easily to the outlet nozzle, so that the dust collection performance can be improved.

Further, in a case where the signal from the switch operation unit is transmitted using infrared light, a supersonic wave or a radio wave, rather than the conventional electrical signal line to the main body of the vacuum cleaner, it is unnecessary to mount a core wire in the interior of the hose and the extension pipe, and accordingly, an extension pipe and a hose of light weight construction can be employed, resulting in a further improvement in the operation.

Further, since it is unnecessary to electrically connect the hose at both ends of the coupling, a comparatively simple structure can be obtained. Further, an electric wire to which a commercial voltage is applied does not exist in the hose, so that even in a case where, at the worst, the hose is destroyed, the safety of the operator can be assured.

DESCRIPTION OF THE PREFERRED EMBODIMENTS

Embodiment 1

Figure 1:
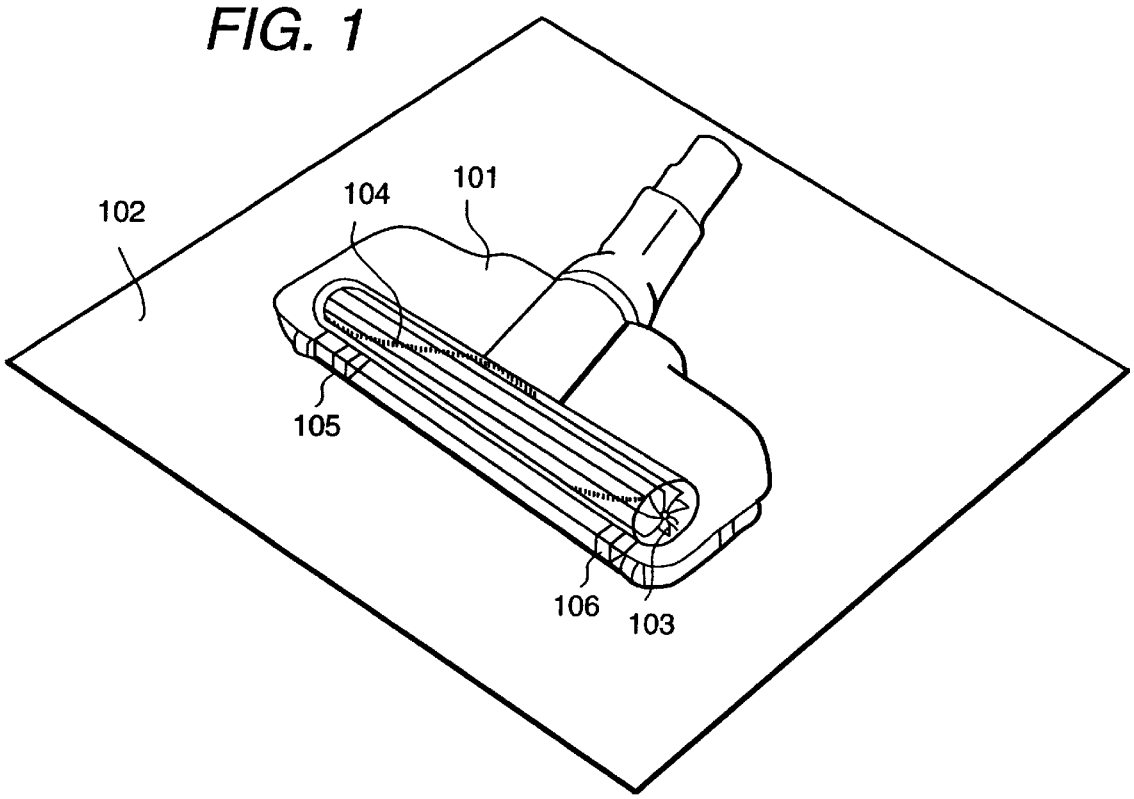
FIG. 1 is a perspective view showing a suction nozzle body representing a first embodiment according to the present invention.

Hereinafter, a first embodiment according to the present invention will be explained in detail while referring to the drawings.

FIG. 1 is a perspective view of a suction nozzle body in which reference numeral 101 denotes a main body of a suction nozzle, 102 denotes a floor surface, 103 denotes an impeller, 104 denotes a brush member wound in a spiral shape around the outer periphery of the impeller, and 105–106 denote air inlet nozzles for sucking air from outside into the suction nozzle body.

Figure 2:
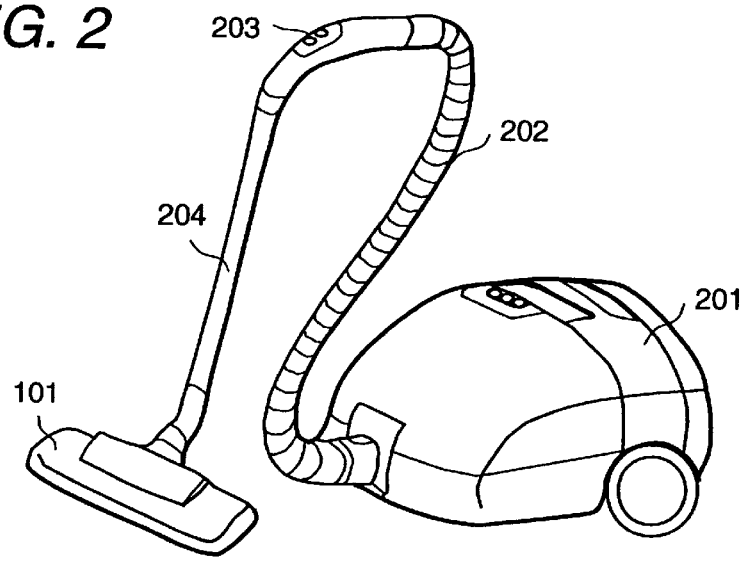
FIG. 2 is a perspective view showing the overall appearance of a vacuum cleaner according to the present invention.

FIG. 2 shows the overall appearance of a vacuum cleaner according to this embodiment, wherein reference numeral 201 denotes a main body of the vacuum cleaner, 203 denotes a switch operation unit arranged in a handle position at the end of a hose 202, 204 denotes an extension pipe, and 101 denotes the suction nozzle main body.

Figure 3:
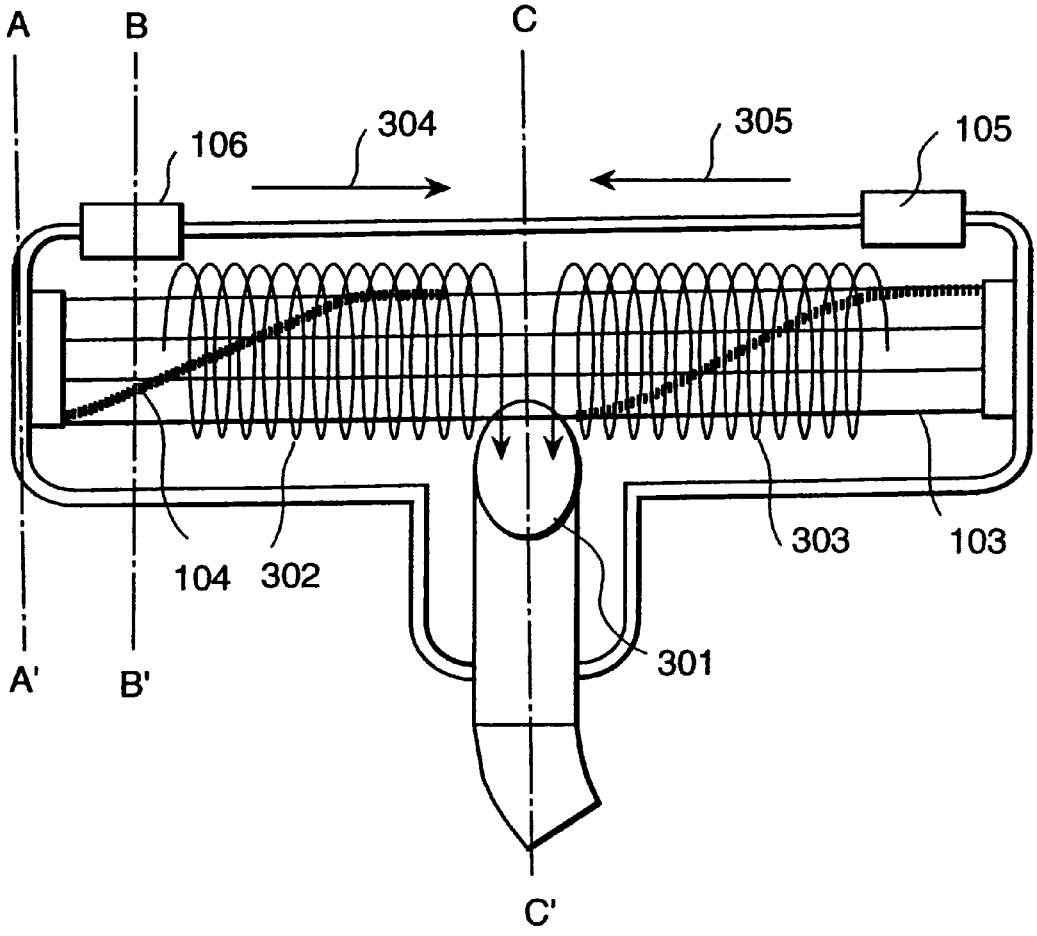
FIG. 3 is a bottom plan view showing a suction nozzle body of the first embodiment according to the present invention.

FIG. 3 is a plan view of the suction nozzle main body 101. In FIG. 3, reference numeral 301 denotes an outlet nozzle of the suction nozzle body, and 302–303 denote swirling air flows.

Figure 4:
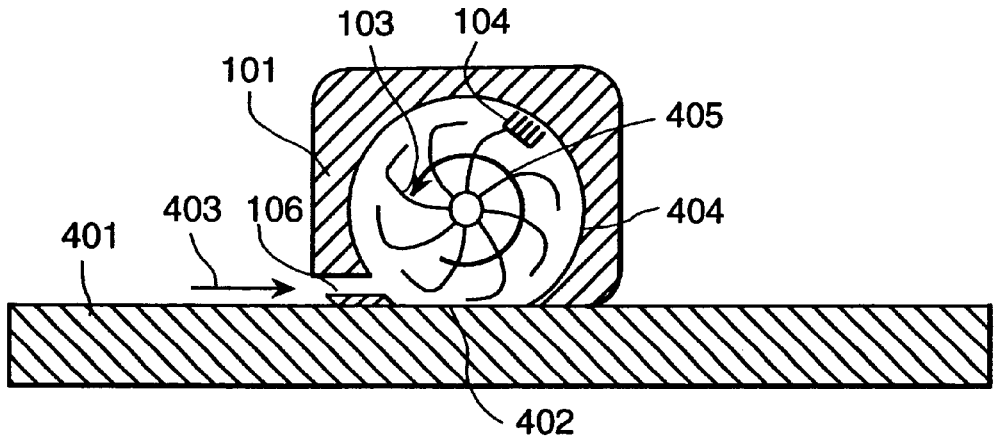
FIG. 4 is a cross-sectional view, taken along line B–B' in FIG. 3, showing a suction nozzle body of the first embodiment according to the present invention.

FIG. 4 is a cross-sectional view taken along line B–B' in FIG. 3 of the suction nozzle main body 101. The reference numeral 401 denotes a carpet, 402 denotes an opening facing the floor surface, and 403 and 405 denote arrows showing the flow directions of air entering and flowing through the suction nozzle.

Figure 5:
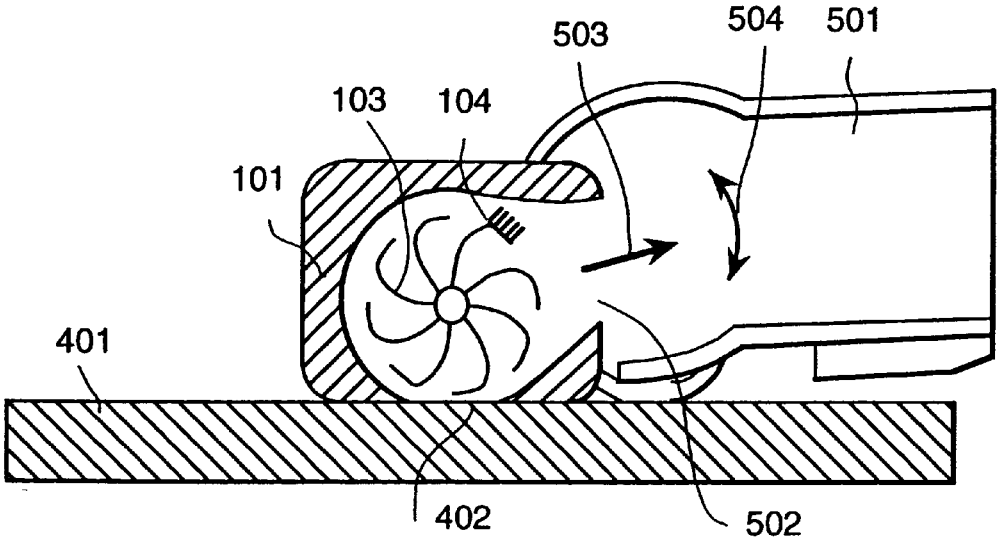
FIG. 5 is a cross-sectional view, taken along line C–C' in FIG. 3, showing the suction nozzle body of the first embodiment according to the present invention.

FIG. 5 is a cross-sectional view taken along line C–C' in FIG. 3 of the suction nozzle main body 101. The reference numeral 501 denotes a coupling portion of the suction nozzle body, 502 denotes an outlet nozzle, 503 denotes an arrow showing a flow direction of air, and 504 denotes an arrow that the coupling portion 501 of the suction nozzle body is able to move upwardly and downwardly.

Figure 6:
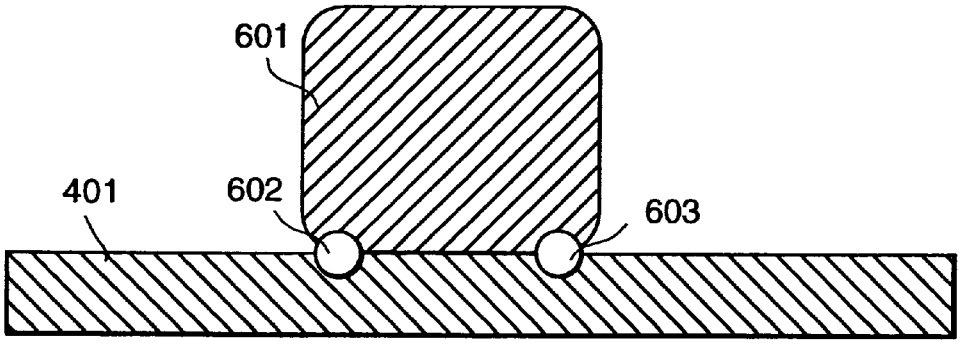
FIG. 6 is a cross-sectional view, taken along line A–A' in FIG. 3, showing the suction nozzle body of the first embodiment according to the present invention in the case of cleaning a carpet.

FIG. 6 is a cross-sectional view taken along line A–A' in FIG. 3 of the suction nozzle main body 101. The reference numeral 601 denotes a side face of the suction nozzle body and 602–603 denote wheels for use in effecting movement over the flooring.

Next, an example of the operation of the first embodiment according to the present invention will be explained.

When an operator of the vacuum cleaner operates the switch operation unit 203 of the hose handle portion, an electric blower motor of the vacuum cleaner main body 201 is driven. The suction force generated by the electric blower motor passes through the hose 202 and the extension pipe 204 and reaches the suction nozzle main body 101.

Since the opening portion 402 of the suction nozzle, as shown in FIG. 4, is closed by the carpet 401, air is sucked in the suction nozzle main body 101 from the air inlet nozzles 106 and 105 and collides with the impeller 103, generating a torque which forces the impeller 103 to rotate. After that, the air collides with a wall face 404 in the interior portion of the suction nozzle body, and the velocity of the air is changed to a rotation angular velocity and the air rotates with a high speed of rotation in the direction of the arrow 405.

At the same time, as shown in FIG. 3, since the air is sucked from the outlet nozzle 301, the air moves in the axial directions 304 and 305 as it rotates, thereby generating the swirling air flows 302 and 303 along a center axis which is substantially parallel to the floor surface 401. Since the swirling air flows 302 and 303 rotate around the surrounding periphery of the impeller 103, the impeller is given a further torque.

The dust on the carpet is swept up from the floor surface into the opening portion 402 by the brush member 104 and also is transported by the swirling air flows 302 and 303. The air passes through the outlet nozzle 502 and is sucked into the vacuum cleaner main body 201 via the extension pipe 204 and the hose 202.

Further, as shown in FIG. 6, since the wheels 602–603 are sunk down into the carpet, a gap formed between the opening portion 402 and the floor surface 401 disappears, so that almost all of the air is sucked through the inlet nozzles 105–106. Therefore, the impeller 103 rotates at a high speed.

Figure 7:
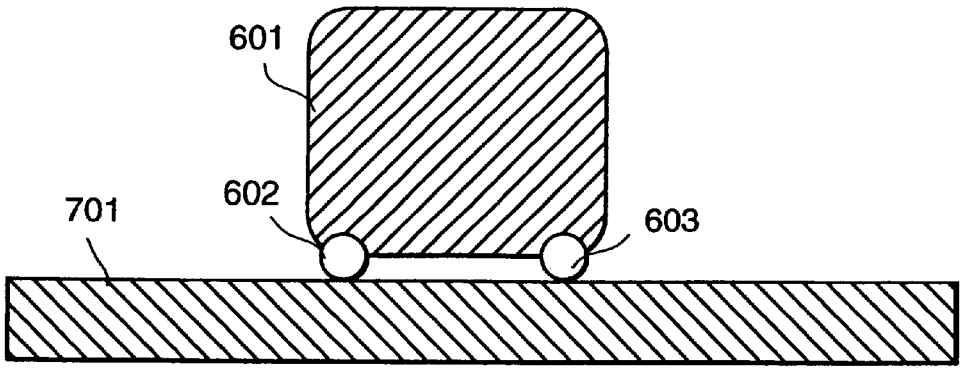
FIG. 7 is a cross-sectional view, taken along line A–A' in FIG. 3, showing the suction nozzle body of the first embodiment according to the present invention in the case of cleaning a hard floor.

However, as shown in FIG. 7, the wheels 602–603 will hardly sink down on a hard flooring or a tatami, so that a gap is formed in this case between the opening portion 402 and the floor surface 401, as a result of which less air is sucked through the inlet nozzles 105–106. Accordingly, the rotation velocity of the impeller 103 becomes small, and the proper rotation suited for a particular flooring or a tatami can be obtained automatically.

Further, when the suction nozzle body is lifted up, since almost all of the air is sucked through the floor face opening portion 402, the impeller 103 hardly rotates; therefore, even when the operator accidentally inserts his or her fingers in the suction nozzle body, a high degree of safety can be obtained.

Figure 8:
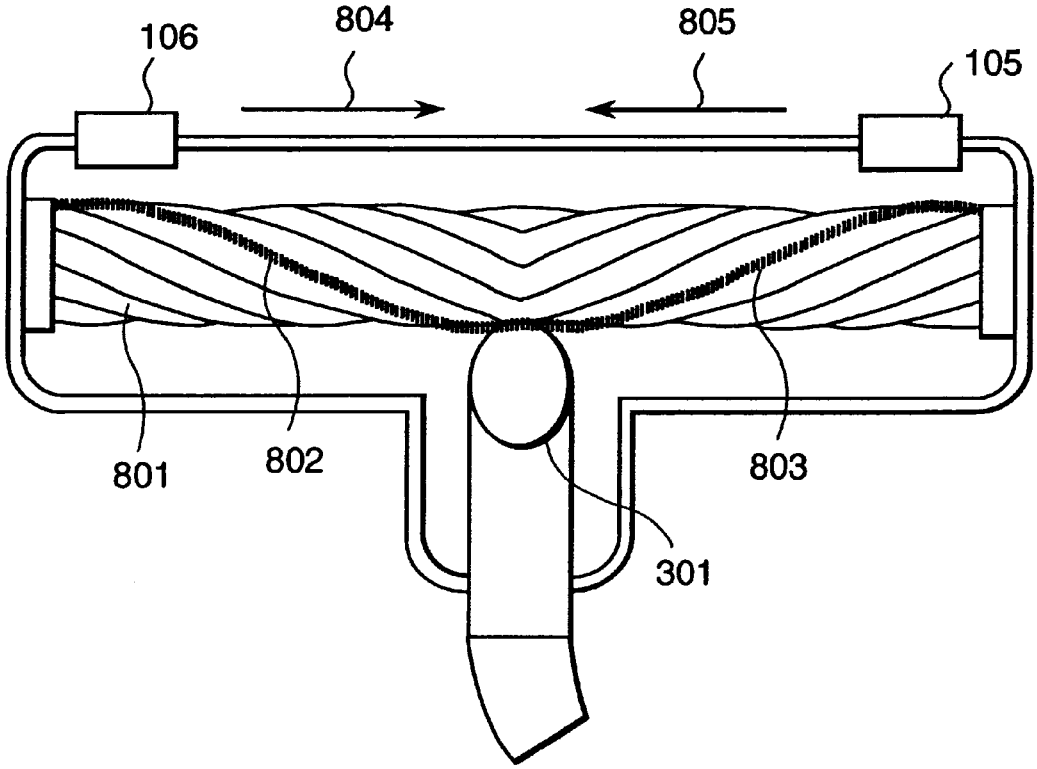
FIG. 8 is a bottom plan view showing a suction nozzle body of a second embodiment according to the present invention.

Further, as shown in FIG. 8, an impeller 801 has a twist construction, and by utilizing the energy of components of the axial direction flows 804, 805 directed toward the center from both sides of the swirling air flow in the suction nozzle body, it is possible to improve the rotation torque of the impeller 801. In this case, in a right half and a left half of the impeller 801, since the axial direction flows 804, 805 have opposite directions of flow, the twist directions have a reverse construction.

Figure 9:
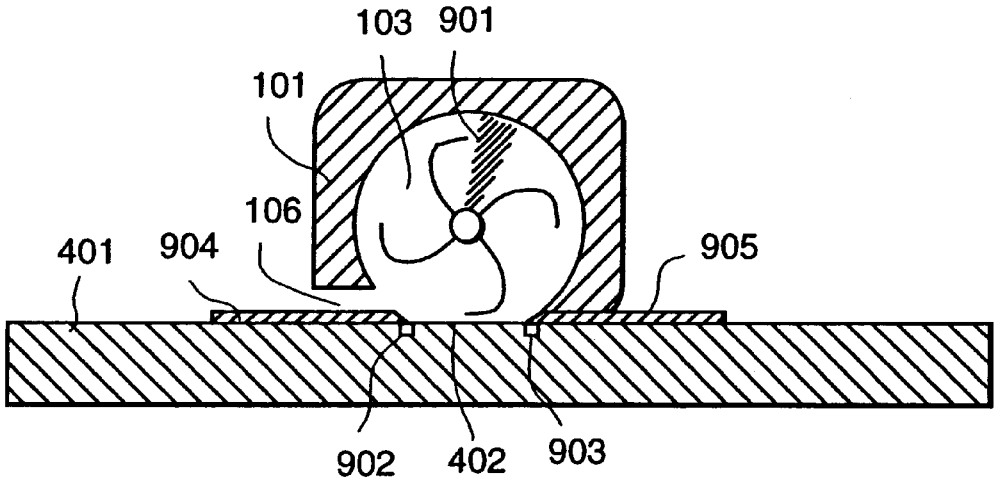
FIG. 9 is a cross-sectional view showing a suction nozzle body of the second embodiment according to the present invention.

Further, it is possible to arrange the brush member 802, 803 on a shaft of the impeller along the twist line the blade member. Further, it is possible to mount rubber members 902–903 and plate members 904–905 at the peripheral edge of the opening portion 402, as seen in FIG. 9, and then by increasing the degree of closure of the opening portion 402, the amount of air sucked through the inlet nozzles 105–106 can be increased and the rotation torque of the impeller can be improved.

In this embodiment, two nozzles are provided and the air is sucked from the both sides of the suction nozzle body, however it is not always necessary to provide the two portions, since the suction nozzle body can be opened by making all of the front face of the suction nozzle body in the form of a nozzle. Further, a nozzle can be provided at the rear face of the suction nozzle body, whereby it is possible to reverse the rotation direction of the impeller.

Figure 10:
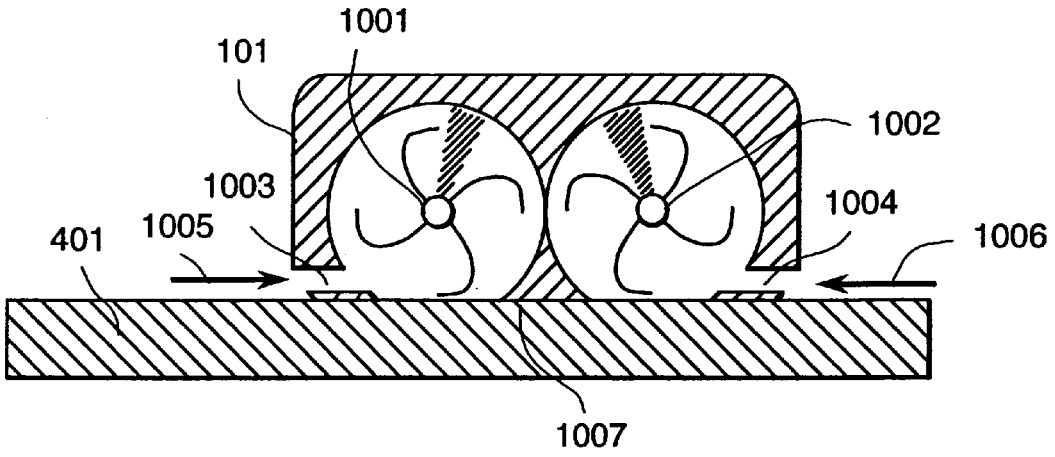
FIG. 10 is a cross-sectional view showing a suction nozzle body of a third embodiment according to the present invention.

Further, as shown in FIG. 10, by the provision of two impellers and by the provision of inlet nozzles on a front portion and a rear portion of the suction nozzle body, whereby the impellers will rotate with opposite rotation directions, it is possible to improve the dust collection ability.

Figure 11:
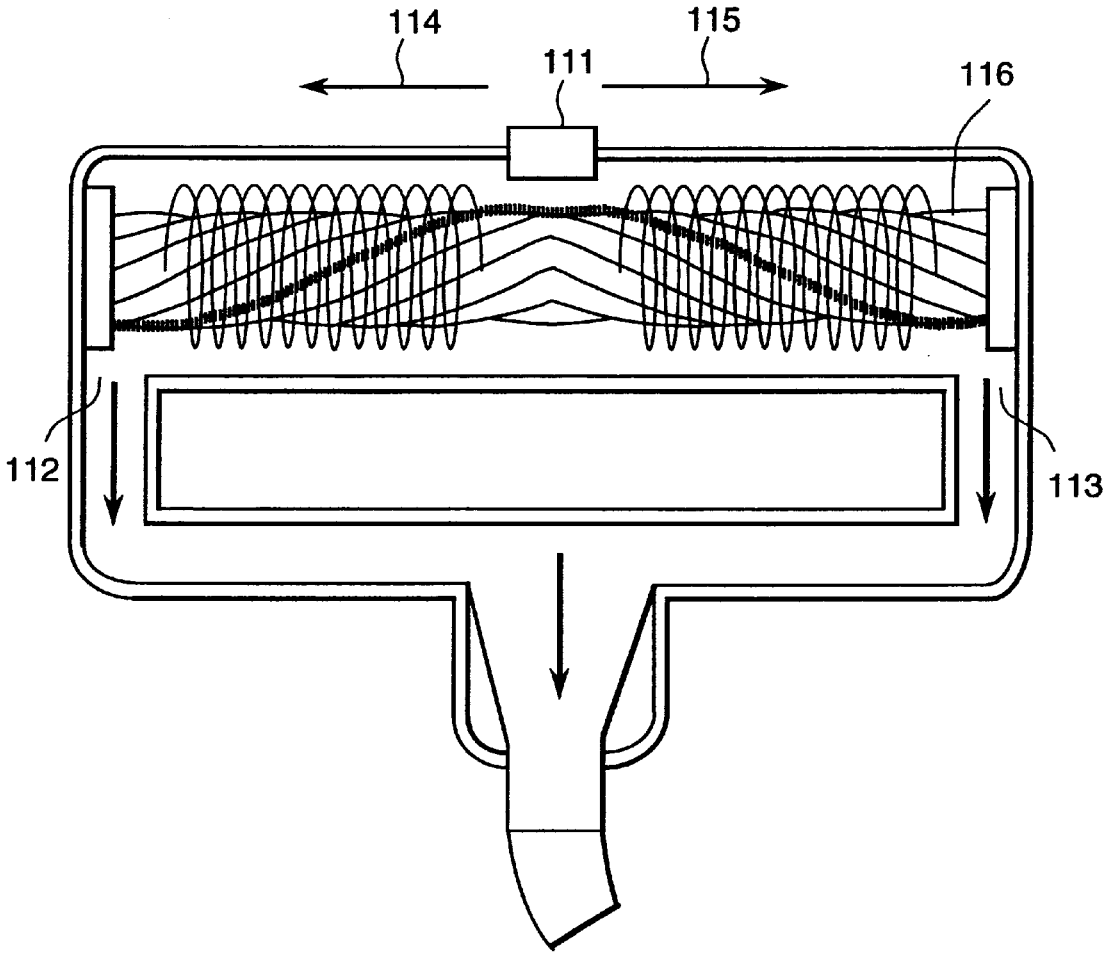
FIG. 11 is a bottom plan view showing a suction nozzle body of a fourth embodiment according to the present invention.

Further, as shown in FIG. 11, an inlet nozzle 111 can be provided at a center portion of the suction nozzle body, and further the air flows indicated by arrows 114, 115 can be can be directed toward opposite ends of the suction nozzle body. In this case, since the axial direction flows 114, 115 of the air flows become reversible, the twist constructions of the impeller 116 become reversible.

As stated above, according to this embodiment, the impeller and the brush member are constituted on the same shaft, and so a vacuum cleaner suction nozzle body having the small size, light weight and silent operation can be provided.

Further, in case the suction nozzle body is lifted off the floor, since the rotation of the impeller automatically weakens or stops, noise due to the high rotation of the rotary brush is not generated, and further safe operation can be obtained even when the operator accidentally places his or her fingers into the suction nozzle body.

Further, at the portion where the brush member contacts the floor surface, since the high speed air flow also contacts the floor surface, the removal of dust from the floor can be performed easily, and the dust can be transported easily to the outlet nozzle, so that the dust collection performance can be improved.

Further, in a case where by the provision of means for transmitting a signal from the switch operation unit using an infrared light, a supersonic wave or a radio wave instead of using a signal line to the main body of the vacuum cleaner, the core wire typically used for this purpose and which has been mounted heretofore in the interior portion of the hose and the extension pipe is not needed, and accordingly an extension pipe and also hose of light weight construction can be used, and further the overall operation can be improved.

Further, since it is unnecessary to electrically connect the hose at both ends of the coupling, a comparatively simple structure can be obtained. Further, since the electric wire to which a commercial voltage is applied does not exist in the hose, even in a case where, at the worst, the hose is destroyed, the safety of the operator can be assured.

Embodiment 2

Hereinafter, a second embodiment according to the present invention will be explained in detail while referring to the drawings.

Figure 12:
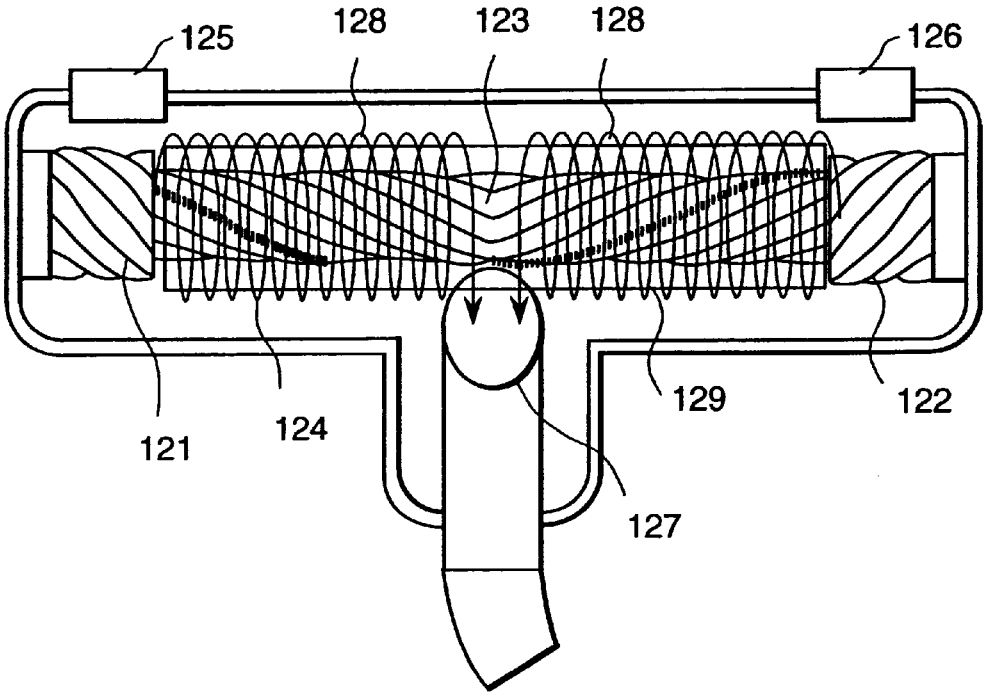
FIG. 12 is a bottom plan view showing a suction nozzle body of the second embodiment according to the present invention.

FIG. 12 shows a plan view of a suction nozzle body. In FIG. 12, reference numerals 121–122 denote large diameter impellers, 123 denotes a small impeller, 124 denotes a brush member, 125–126 denote inlet nozzles for sucking air from outside into the suction nozzle body, 127 denotes an outlet nozzle of the suction nozzle body, and 128–129 denote swirling air flows.

Next, an example of the operation of the second embodiment according to the present invention will be explained.

When an operator of the vacuum cleaner operates the switch operation unit 203 of the hose handle portion, an electric blower motor of the vacuum cleaner main body 201 is driven. The suction force generated by the electric blower motor passes through the hose 202 and the extension pipe 204 and reaches the suction nozzle body main body 101.

Since the opening portion 129 of the suction nozzle is closed by the carpet, the air is sucked through the inlet nozzles 125 and 126 and collides with the impellers 121 and 122, generating a torque which forces the impellers to rotate, so that the air becomes a swirling air flow 128. Since the swirling air flow 128 also rotates around the periphery of the small diameter impeller 123, the impeller is subjected to a further torque.

The dust on the carpet is swept up by the rotating brush member 124 and also is transported by the swirling air flow 128. The air passes through the outlet nozzle 127 and is sucked into the vacuum cleaner main body 201.

Further, when the suction nozzle body is lifted up, since almost all of the air is sucked through the opening portion 129, the impeller 123 hardly rotates, therefore, even when the operator accidentally inserts his or her fingers in the suction nozzle, complete safety can be assured.

Figure 13:
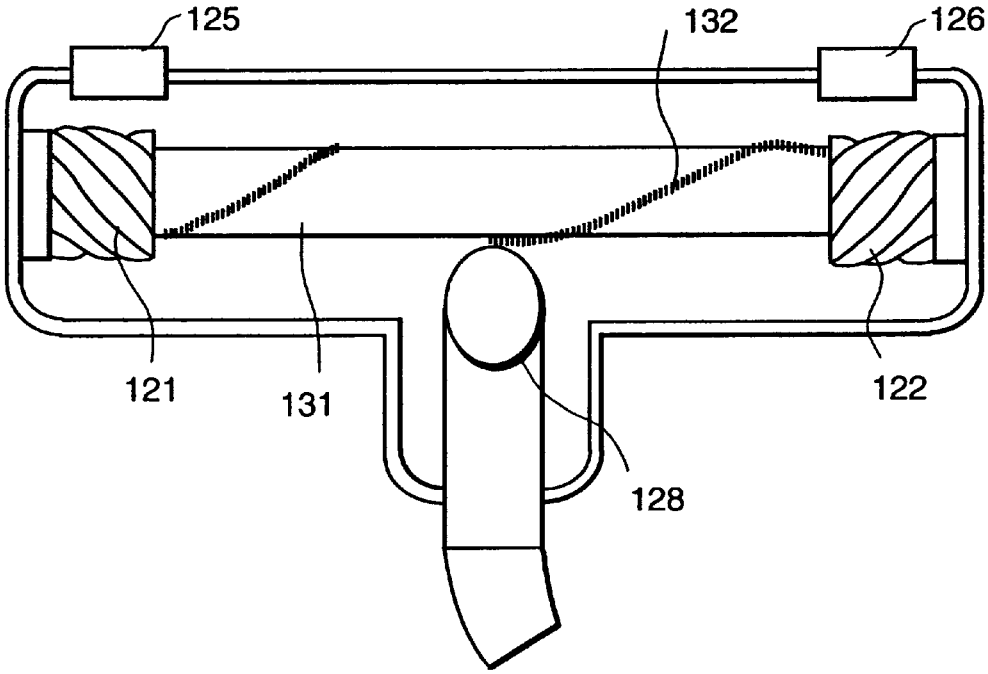
FIG. 13 is a bottom plan view showing a suction nozzle body of the second embodiment according to the present invention.

Further, as shown in FIG. 13, in a case where the torque generated by the large diameter impellers 121 and 122 is itself sufficient to provide proper rotation, the center portion 131 can be constituted simply as a shaft, and with this construction, it is possible to dispense with the installation of the impeller 123 and provide only the brush member 132 on the center shaft 131.

As stated above, according to this embodiment, the impeller and the brush member are constituted on the same shaft, the suction nozzle body of the vacuum cleaner has a small size, is light in weight and silent in operation, and so a vacuum cleaner having an improved suction nozzle body can be provided.

Further, according to this embodiment, the center portion of the impeller can be formed to have a smaller diameter, thereby contributing further to the small size and light weight construction. Further, a part of the suction nozzle body under a lower portion of the large diameter impeller which constitutes the opening portion of the suction nozzle is enclosed, so that in a case where a carpet having long fibers, such a shaggy carpet etc. enters into the suction nozzle body, the carpet does not collide with the impeller, with the result that the rotation of the impeller will not be stopped or obstructed by the carpet fibers.

Further, in a case the suction nozzle is lifted off the carpet, since the rotation of the impeller automatically weakens or stops, noise due to high rotation of the rotary brush is not generated, and complete safety can be assured even if the operator accidentally inserts his or her fingers into the suction nozzle body.

Further, at the portion of the nozzle where the brush member contacts the floor surface, since the high speed air flow also contacts the floor surface, the removal of dust from the floor surface can be performed easily, and the dust can be transported easily to the outlet nozzle, whereby the dust collection performance can be improved.

Further, in a case where means is provided for transmitting the signal from the switch operation unit using infrared light, a supersonic wave or a radio wave rather than the typical signal line to the main body of the vacuum cleaner, it is unnecessary to mount a signal wire in the interior portion of the hose and the extension pipe, and accordingly the extension pipe and also the hose can be of a light weight construction, so that the overall operation can be improved.

Further, since it is unnecessary to electrically connect the hose at both ends of the coupling, a comparatively simple structure can be obtained. Further, since the electric wire to which a commercial voltage is applied does not exist in the hose, even in a case where, at the worst, the hose is destroyed, the safety of the operator can be assured.

What is claimed is:

1. A vacuum cleaner comprising an electric blower motor for generating a suction force, a casing for housing said electric blower motor, a dust collection part provided at a suction side of said electric blower motor, an air conduit having one end connected to said dust collection part and an other end connected to a suction nozzle body to apply the suction force of said electric blower motor to a surface to be subjected to cleaning, wherein:

said suction nozzle body includes an opening at a portion thereof which opposes said surface to be subjected to cleaning;

an impeller extending in a longitudinal direction is provided in an interior portion of said suction nozzle body and is mounted for rotation about a longitudinal rotary axis by air flow produced by said suction force, said impeller having a plurality of vanes extending in the longitudinal direction and spaced from one another in a circumferential direction, and a brush member extending between adjacent ones of said vanes in both the circumferential and longitudinal direction of said impeller; and said suction nozzle body includes at least one air inlet nozzle therein separated from and independent of air flow through said opening of said suction nozzle body and located within a longitudinal extent of said impeller so that air outside of said suction nozzle body is sucked therethrough and is blown toward said vanes of said impeller in a direction transverse to the rotary axis of said impeller to rotate said impeller.

2. A vacuum cleaner according to claim 1, characterized in that the length of said impeller is longer than a half of the length in a longitudinal direction of said interior portion of said suction nozzle body.

3. A vacuum cleaner according to claim 1, characterized in that said brush member extends beyond an outer periphery of said vanes of said impeller.

4. A vacuum cleaner according to claim 1, characterized in that said suction nozzle body includes a housing provided to enclose said impeller, and said opening of said suction nozzle is provided in said housing which opens toward a floor surface to be cleaned and through which dust is drawn when the floor is cleaned.

5. A vacuum cleaner according to claim 4, characterized in that separately provided air inlet nozzles are provided in said suction nozzle body and are located in the vicinity of both ends of said suction nozzle body for sucking air into said suction nozzle body from the outside; and an air outlet nozzle is formed at a portion of said suction nozzle body where a tip end of said air conduit is connected at a center portion of said suction nozzle body, so that, with respect to said air outlet nozzle, said air inlet nozzles in the vicinity of the respective ends of said suction nozzle body are arranged symmetrically.

6. A vacuum cleaner according to claim 1, characterized in that said switch operation unit comprises a switch group for controlling ON-OFF operation of a power source for said electric blower motor, and further means for transmitting an operation signal from said switch operation unit to a main body of the vacuum cleaner through a radio wave.

7. A vacuum cleaner according to claim 1, characterized in that a vane of said impeller set has a twist construction.

8. A vacuum cleaner according to claim 1, characterized in that wheels are attached to at least one of a bottom portion and a side portion of said casing, whereby depending on a difference in the amount the wheels sink into a surface to be subjected to cleaning, the rotation speed of said impeller is varied with variation of the floor surface from a carpet to a hard floor.

9. A vacuum cleaner according to claim 8, characterized in that the rotation speed of said impeller on a carpet is larger than the rotation speed thereof during a time when said suction nozzle body is lifted off the surface to be cleaned.

10. A vacuum cleaner according to claim 8, characterized in that the rotation speed of said impeller on a carpet is larger than the rotation speed thereof on a hard floor, and the rotation speed of said impeller on a hard floor is larger than the rotation speed thereof during the time when said suction nozzle body is lifted off the surface to be cleaned.

11. A vacuum cleaner according to claim 8, characterized in that the rotation torque of said impeller on a carpet is larger than the rotation torque of said impeller during the time when said suction nozzle body is lifted off said surface to be cleaned.

12. A suction nozzle body for a vacuum cleaner in which suction force produced by an electric blower motor is used for cleaning a surface to be subjected to cleaning comprising: a housing; an impeller extending in a longitudinal direction is installed in an interior portion of said housing for rotation about a longitudinal rotary axis in response to air flow produced by said suction force, said impeller having a plurality of vanes extending in the longitudinal direction and spaced from one another in a circumferential direction, and a brush member extending between adjacent ones of said vanes in both the circumferential and longitudinal direction of said impeller; said housing including an opening at a portion thereof which opposes said surface to be subjected to cleaning and at least one air inlet nozzle separated from and independent of air flow through said opening and located within the longitudinal extent of said impeller so that air outside of said housing is sucked therethrough and is blown toward said vanes of said impeller in a direction transverse to the rotary axis of said impeller to rotate said impeller.

13. A suction nozzle body of a vacuum cleaner according to claim 12, characterized in that the length of said impeller is longer than a half of the length in a longitudinal direction of said interior portion of said suction nozzle body.

14. A suction nozzle body of a vacuum cleaner according to claim 12, characterized in that said brush member extends beyond an outer periphery of said vanes of said impeller.

15. A suction nozzle body of a vacuum cleaner according to claim 12, characterized in that said housing encloses said impeller, and said opening is provided in said housing which opens toward a floor surface to be cleaned and through which dust is drawn when the floor is cleaned.

16. A suction nozzle body of a vacuum cleaner according to claim 12, characterized in that separately provided air inlet nozzles are provided and are located in the vicinity of both ends of said housing for sucking air into said housing from the outside to rotate said impeller; and an air outlet nozzle is formed at a portion of said housing body where a tip end of an air conduit is to be connected at a center portion of said suction nozzle body, so that, with respect to said air outlet nozzle, said air inlet nozzles in the vicinity of respective end portions thereof, ends of said housing are arranged symmetrically.

17. A vacuum cleaner according to claim 1, characterized in that said at least one air inlet nozzle is provided at both sides in a direction of the rotary axis with respect to a position where a center line of the rotary axis of said impeller and a center line of an air outlet nozzle intersect.

18. A vacuum cleaner according to claim 1, characterized in that said impeller has a vane face which receives air from said at least one air inlet nozzle.

19. A vacuum cleaner according to claim 1, characterized in that air which is sucked into an interior portion of said suction nozzle body from said at least one air inlet nozzle is blown successively to adjacent vanes of said impeller in the a circumferential direction of said impeller in accordance with rotation of said impeller.

20. A vacuum cleaner according to claim 1, characterized in that said at least one air inlet nozzle is located so as to be opposed to said vanes of said impeller so that air sucked therethrough is directly applied to said vanes of said impeller so as to rotate said impeller.

21. A suction nozzle body of a vacuum cleaner according to claim 12, characterized in that said at least one air inlet nozzle is located so as to be opposed to said vanes of said impeller so that air sucked therethrough is directly applied to said vanes of said impeller so as to rotate said impeller.

* * * * *